United States Patent [19]

Beck, Jr.

[11] Patent Number: 4,784,623

[45] Date of Patent: Nov. 15, 1988

[54] MASS TERMINABLE FLAT FLEXIBLE CABLE TO PIN CONNECTOR

[75] Inventor: Hoy S. Beck, Jr., Lexington, N.C.

[73] Assignee: AMP Incorporated, Harrisburg, Pa.

[21] Appl. No.: 34,802

[22] Filed: Apr. 3, 1987

[51] Int. Cl.[4] ..... H01R 13/432

[52] U.S. Cl. ..... 439/872; 439/422; 439/498

[58] Field of Search ..... 439/391, 393, 404–406, 439/421, 422, 424, 426, 427, 430, 442, 439, 597, 498, 499, 493, 866, 872, 877, 882, 629

[56] References Cited

U.S. PATENT DOCUMENTS

| | | | |
|---|---|---|---|
| 3,656,093 | 4/1972 | Kinkaid | 439/872 |
| 3,947,083 | 3/1976 | Ahmed et al. | 439/872 |
| 3,966,295 | 6/1976 | Huland et al. | 339/176 MF |
| 4,083,615 | 4/1978 | Volinskie | 439/498 |
| 4,561,714 | 12/1985 | Buczek et al. | 339/97 P |
| 4,564,253 | 1/1986 | Sinclair | 439/422 |

*Primary Examiner*—Gil Weidenfeld
*Assistant Examiner*—Paula A. Austin
*Attorney, Agent, or Firm*—Robert W. Pitts

[57] ABSTRACT

A multi-contact electrical connector employing a plurality of terminals mounted in aligned compartments in an insulating housing is especially suited for establishing interconnection between flat conductors in a flat cable and closely spaced free standing pins or posts. This invention is especially suited for use in interconnecting pins and flat conductors on centerline spacings no greater than 0.050 inch. A conductor engaging portion having a horizontal base is joined to a pin engaging portion having resilient arms and a vertical base. The horizontal base is joined directly to the vertical base by an axial bend line and horizontal arms joined to the bend line are not connected directly to the horizontal base of the cable conductor interconnection portion.

19 Claims, 5 Drawing Sheets

MASS TERMINABLE FLAT FLEXIBLE CABLE TO PIN CONNECTOR

BACKGROUND OF THE INVENTION

1. Field of the Invention

This invention relates to an electrical connector of the type employed to make an electrical interconnection between a plurality of conductors and an array of upstanding pins or posts and more particularly relates to an electrical connector suitable for use with multi-conductor flat conductor flexible cable which promotes simultaneous mass termination of all of the conductors within the cable.

2. Description of the Prior Art

Flat conductor flexible cable offers many advantages over discrete wires and over round conductor flexible or ribbon cable. However, in general, it is not as easy to connect electrical terminals to flat conductors as it is for round wires. One crimp terminal that has proven effective in establishing such an interconnection to flat conductors in a flat cable is depicted in U.S. Pat. No. 4,082,402. This device employs a plurality of staggered teeth on the opposite sides of a central base to penetrate the insulation and crimp to the underlying flat conductor. Terminals in accordance with that patent may be stamped and formed from flat stock and inserted into an insulated housing. Conventional resilient contacts suitable for establishing electrical connection with either pins or posts can be employed with terminals using a crimp terminal of the type depicted therein. For example, a dual beam configuration extending vertically upward from the base of the contact terminal disclosed therein establishes electrical interconnection with adjacent sides of pins or posts located within an array. The position of such spring contacts between adjacent terminals, however, limits the centerline spacing of pins for which the connector having a terminal as shown in the above-mentioned patent would be suitable.

U.S. Pat. No. 3,699,502 discloses another device having a box configuration for establishing contact to one of a series of posts or pins. This particular configuration is suitable for use with a crimp to establish contact with posts or pins positioned side by side in a row. This box configuration, however, also establishes contact with the adjacent sides of posts within the row. Furthermore, the configuration of the terminal shown in U.S. Pat. No. 3,699,502 requires that the terminal be formed from a stamped blank significantly wider than the final width of the terminal. Thus, these terminals cannot be positioned in a closely spaced arrangement on a single carrier strip if stamped from the same flat stock.

One method of obtaining closer spacing for terminals stamped from a blank having a width substantially greater than the final width of the terminal is to employ stackable terminal arrays on carrier strips with the individual terminals offset. Thus, an assembly consisting of a plurality of arrays, each on a separate carrier strip can be positioned for insertion into an insulated housing having a plurality of cavities. U.S. Pat. No. 4,021,095 discloses a stackable carrier strip arrangement to facilitate closer centerline spacing.

Increased usage of high density circuit applications have made it impossible to employ the same configurations for interconnecting pins on closely spaced centerlines. For example, the box configuration shown in U.S. Pat. No. 3,699,502 is unsuitable for forming interconnection between posts or pins located on centerlines no greater than 0.050 inch. A new resilient pin connector employing resilient spring arms engaging the top and bottom of pins arranged in a horizontal row has been developed commensurate with the instant invention and is suitable for establishing interconnections on 0.050 inch centerlines. The instant invention permits such a closely spaced pin contact configuration to be employed with a standard flat conductor flat cable crimp such as that shown in U.S. Pat. No. 4,082,402.

SUMMARY OF THE INVENTION

The instant invention discloses a terminal for use in an electrical connector suitable for establishing interconnection between closely spaced conductors such as upstanding posts or pins on centerlines no greater than 0.050 inch and flat conductor flat cables having a conductor centerline spacing also no greater than 0.050 inch. The terminal employed in this invention is insertable into side by side compartments in a multi-position insulated housing. Each terminal has a first or cable conductor interconnection portion having a horizontal base with conductor engaging elements formed upwardly from the horizontal base. In the preferred embodiment of this invention, teeth or crimping tangs are formed upwardly from the horizontal base. These crimping tangs are deformable into crimping engagement with a flat conductor. A resilient pin contact portion is located on the opposite end of each terminal and employs a vertical, rather than a horizontal, base having two opposed resilient arms extending from the opposite sides of the base. In the preferred embodiment of this invention, these resilient arms extend horizontal relative to the vertical base, with one of the horizontal arms being generally in the same plane as the horizontal base of the cable interconnection portion. The horizontal arm of the pin connector portion is not, however, attached to the horizontal base of the cable interconnection portion but is instead only attached to the vertical pin connector base. The vertical base is integrally attached to the horizontal base with a right angle bend line forming a transition from the horizontal base of the cable contact portion to the vertical base of the pin interconnection portion. Interconnection of the vertical base directly to the horizontal base, rather than interconnection between the horizontal base and a horizontal resilient arm in the same plane, permits the relatively small terminals in accordance with this invention to be precisely and repetitively stamped and formed within acceptable tolerances.

BRIEF DESCRIPTION OF THE DRAWINGS

FIG. 3 is a view of the connector with the terminals fully inserted into the housing in contact with flat conductors in a flat insulated cable, the connector being suitable for interconnecting to a plurality of upstanding pins or posts.

FIG. 5 is a view of the terminal at an intermediate forming stage.

DETAILED DESCRIPTION OF THE PREFERRED EMBODIMENT

Figures 1, 2:
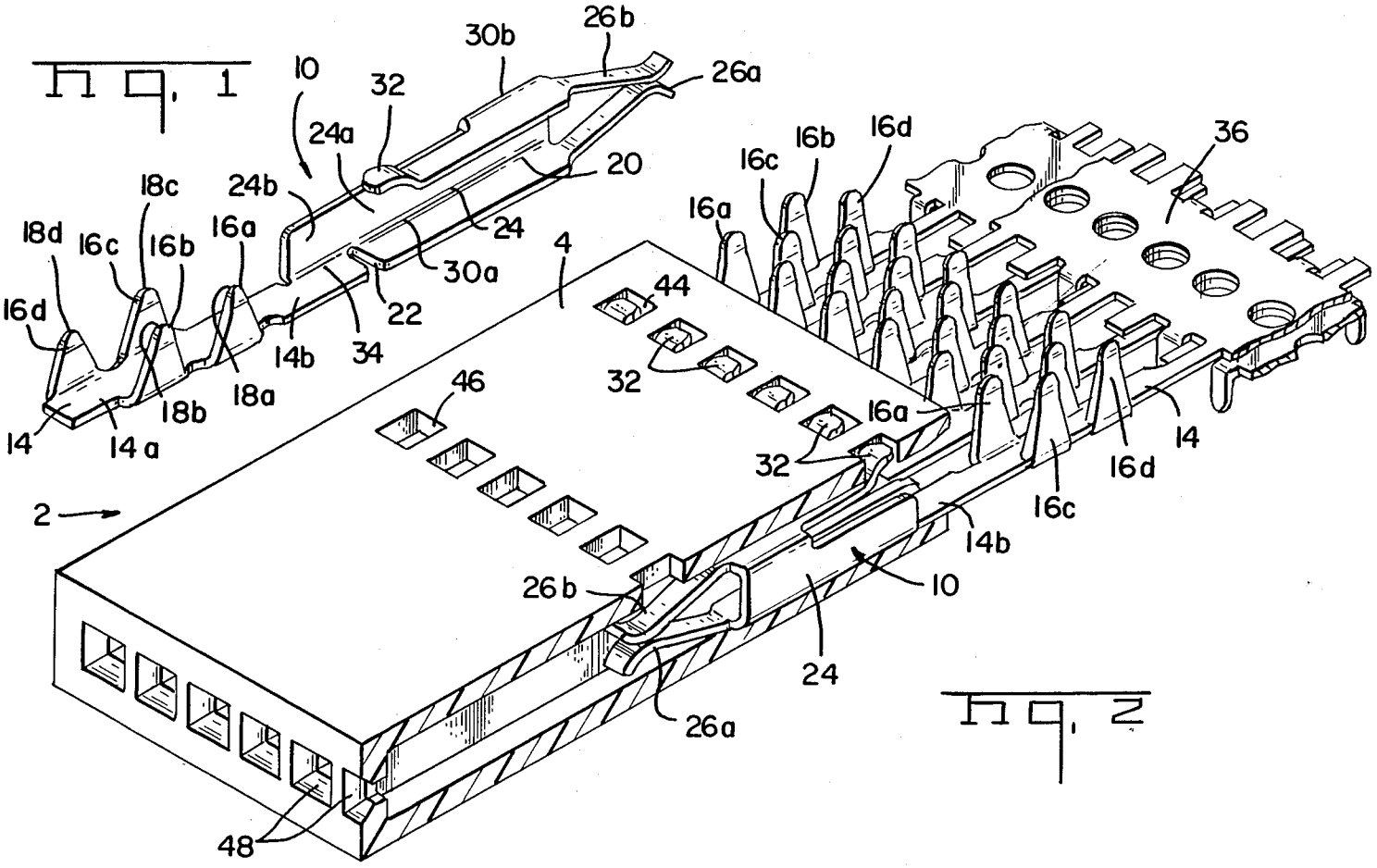
FIG. 1 is a perspective view of the preferred embodiment of the terminal employed in this invention.
FIG. 2 is an exploded perspective view of a plurality of terminals in two arrays positioned in a partially inserted configuration within an insulated housing.
Figure 1:
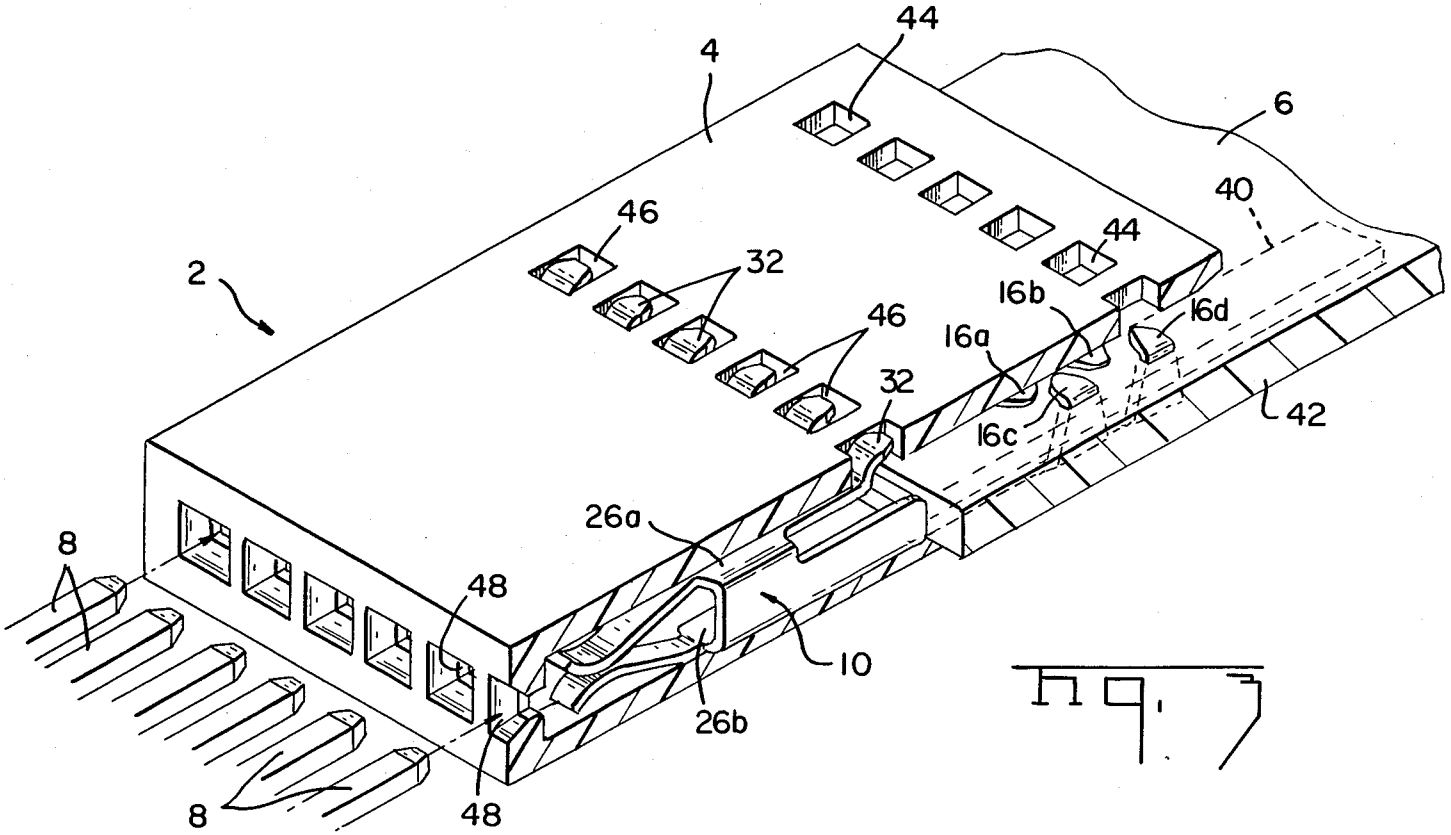

The preferred embodiment of the invention disclosed herein comprises a connector 2 suitable for use in attaching flat conductors in a flat insulated cable 6 to a plurality of upstanding pins or posts 8 in a horizontal row in which the pins and the conductors are spaced apart on centerlines no greater than 0.050 inch. The connector 2 comprises an insulated housing 4 and a plurality of individual terminals 10. The housing 4 is formed of a conventional insulated material and the terminal 10 is formed of a conventional spring metal.

Each terminal 10 employed in this invention is identical to the other terminals and comprises a first cable conductor interconnection portion 12 suitable for establishing a crimped contact with individual cable conductors 40 and a second pin interconnecting portion 20 integral with the conductor interconnection portion 12 and located on the opposite end of the stamped metal blank from which the individual terminals 10 are formed. Each of the terminals 10 is carried on a frangible carrier strip 36. Each carrier strip is attached and integral with a plurality of terminals which are spaced apart by a multiple of the centerline spacing of the adjacent pins 8 and conductors 6. Such relatively wider spacing is necessary because portions of the terminals must be formed upwardly or bent so that the final width of the terminals is significantly less than the initial width of the stamped metal blank from which the terminals are formed.

Each cable conductor interconnection portion 12 comprises a horizontal centrally located base 14 which extends from the carrier strip adjacent one end of the terminal to an intermediate section where the conductor interconnection portion 12 joins and is integral with the pin interconnection portion 20. A plurality of upstanding conductor engaging members or crimp tangs **16*a*, 16*b*, 16*c*, 16*d* are located along opposite sides of the horizontal base 14 of conductor interconnection portion 12. These crimp tangs 16*a*, 16*b*, 16*c*, 16*d* extend upwardly from a first portion of the horizontal base 14*a*. A second portion of the horizontal base 14*b* comprises an extension of the base portion 14*a* located between the crimp tangs 16. This horizontal base extension 14*b* extends inwardly toward the intermediate section of the individual terminals and provides the integral portion joining the pin interconnection portion 20. The crimp tangs 16*a*, 16*b*, 16*c*, 16*d* are staggered on opposite sides of the horizontal base 14 and each crimp tang has a tapered free end 18*a*, 18*b*, 18*c*, 18*d* which is especially suited for penetrating the insulation surrounding conductors 40 in the insulated flat cable 6. These tapered free ends 18 of crimp tangs 16 penetrate the conductors 40 to establish a secure mechanical and electrical interconnection in a conventional manner. Note that the crimp tangs 16 are formed out of the plane of the horizontal base 14 both in the uncrimped configuration shown in FIG. 1 and in the crimped configuration shown in FIG. 3**.

The pin interconnection portion 20 also comprises a base 24. Base 24, however, extends in the vertical plane relative to the horizontal base 14 in the conductor interconnection portion 12. Note that the terms "horizontal" and "vertical" are employed herein merely to denote the relative orientation of the vertical base 24 with respect to the horizontal base 14. First and second resilient arms **26*a* and 26*b* extend from opposite sides of the vertical base 24. In the preferred embodiment of this invention, the resilient arms 26*a* and 26*b* are formed about a right angle relative to the vertical base 24 so that both resilient arms 26*a* and 26*b* will be located in horizontal planes in the final formed configuration. Although each of the resilient arms 26*a* and 26*b* is substantially horizontal, the forward end of each arm has an inwardly formed constricted conductor contact 28*a* and 28*b* which are formed in a conventional manner so that contacts on each arm are closely adjacent. Insertion of a pin 8 between the constricted contacts 28*a* and 28*b* will cause the resilient arms 26*a* and 26*b* to deflect outwardly and will maintain a sufficient normal force to establish a sound electrical interconnection to individual pins. The forward ends of the resilient arms 26*a* and 26*b* extend beyond the vertical base 24. However, bend lines 30*a* and 30*b* are formed along the opposite sides of the vertical base 24 such that the resilient arms 26*a* and 26*b* are each integrally joined to the vertical base 24**.

The lower resilient arm **26*a* is bent at a right angle relative to vertical base 24 such that the lower horizontal arm 26*a* is in substantially the same horizontal plane as the horizontal base 14 of the conductor interconnection portion 12. The lower resilient contact arm 26*a* is, however, not directly joined to the horizontal base 14. A slot 22 extending inwardly from the edge of the contact separates the horizontal base 14 from the lower horizontal resilient arm 26*a*. Although the entire terminal 10 is stamped from an integral blank, the lower horizontal arm 24 is joined only to the vertical base 14 about an intermediate bend line 30*a***.

The second or upper resilient arm **26*b* also extends horizontally relative to the vertical base 24 and is spaced above the plane of the horizontal base 14. Note that resilient arms 26*a* and 26*b* are spaced above and below the vertical base 26 with the constricted contacts 28*a* and 28*b*** configured for engagement with the top and bottom of pins or posts inserted therebetween rather than configured for engagement with adjacent sides of closely spaced pins or posts.

The rearward portion of the second or upper resilient arm **26*b* is separated from the vertical base 24 and is formed outwardly to define a retention lance 32. The resilient arms 26*a* and 26*b* are integrally joined to the vertical base 24 about bend lines 30*a* and 30*b* formed along main base section 24*a*. A base extension 24*b* extends from the vicinity of slot 22 toward the intermediate portion of the terminal and is integrally joined to the horizontal base extension 14*b* about a right angle bend 34. Thus, the horizontal base 14 of the conductor interconnection portion 12 is integrally joined only to the vertical base of the pin interconnection portion 20 through the horizontal base extension 14*b* and the vertical base extension 24*b* in which the right angle bend 34, which extends axially relative to the length of the terminal 10**, is located.

Figure 4:
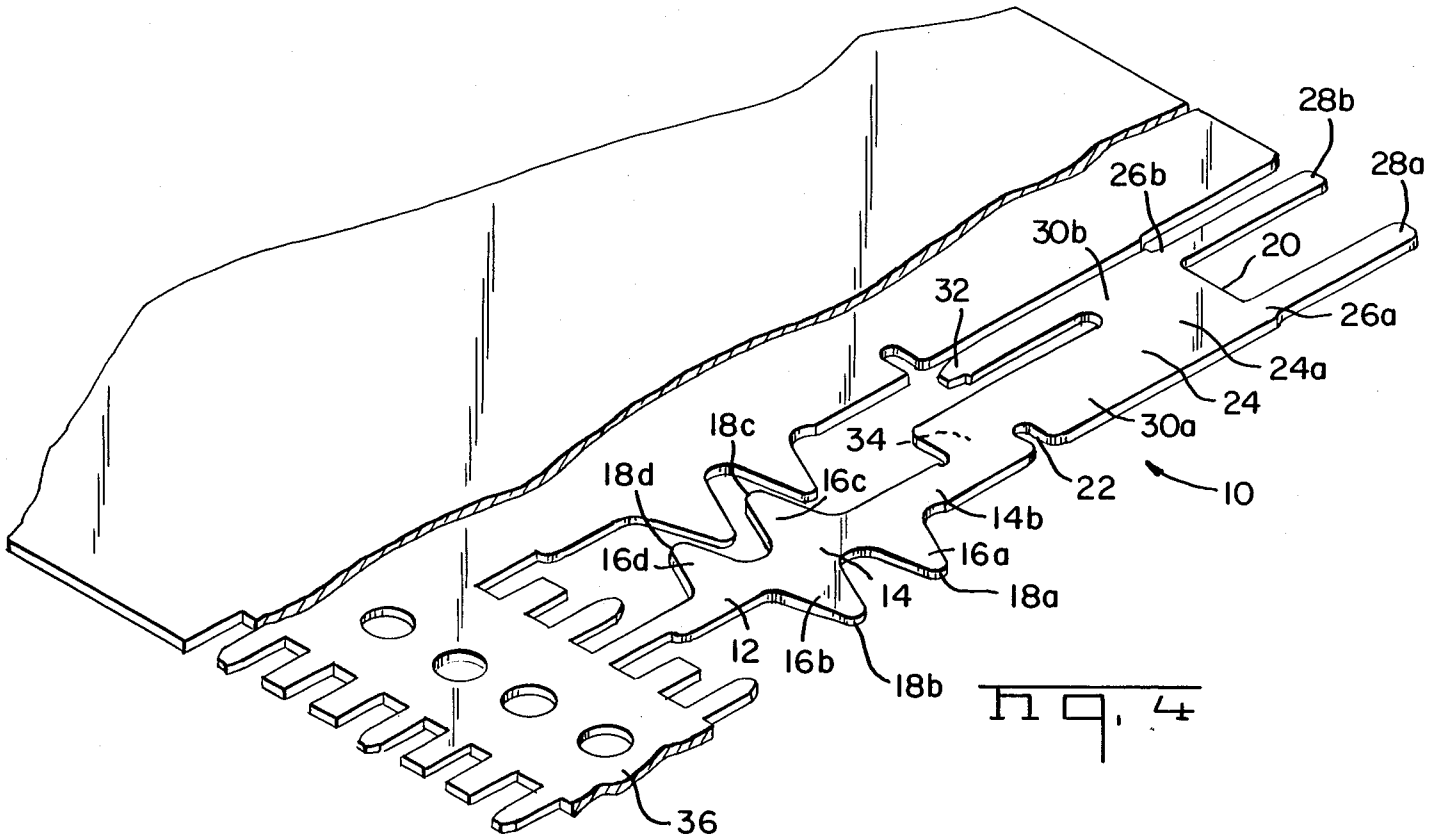
FIG. 4 is a view of the flat blank showing the stamped outline of an individual terminal.

FIGS. 4–7 illustrate progressive stages in the stamping and forming of the integral terminals 10. FIG. 4 shows the configuration of a stamped metal blank. Note that the entire portion of the terminal is in a flat plane in the stamped configuration of FIG. 4. The crimp tangs **16*a*, 16*b*, 16*c*, 16*d* extend outwardly from the opposite sides of the horizontal base portion 14 whereas the resilient arms 26a and 26b in the unformed configuration also extend outwardly relative to the pin interconnection base portion 24. Note that both the conductor interconnection base portion 14 and the pin interconnection base portion 24** are in the same plane in the stamped configuration.

Figures 6, 6A, 7:
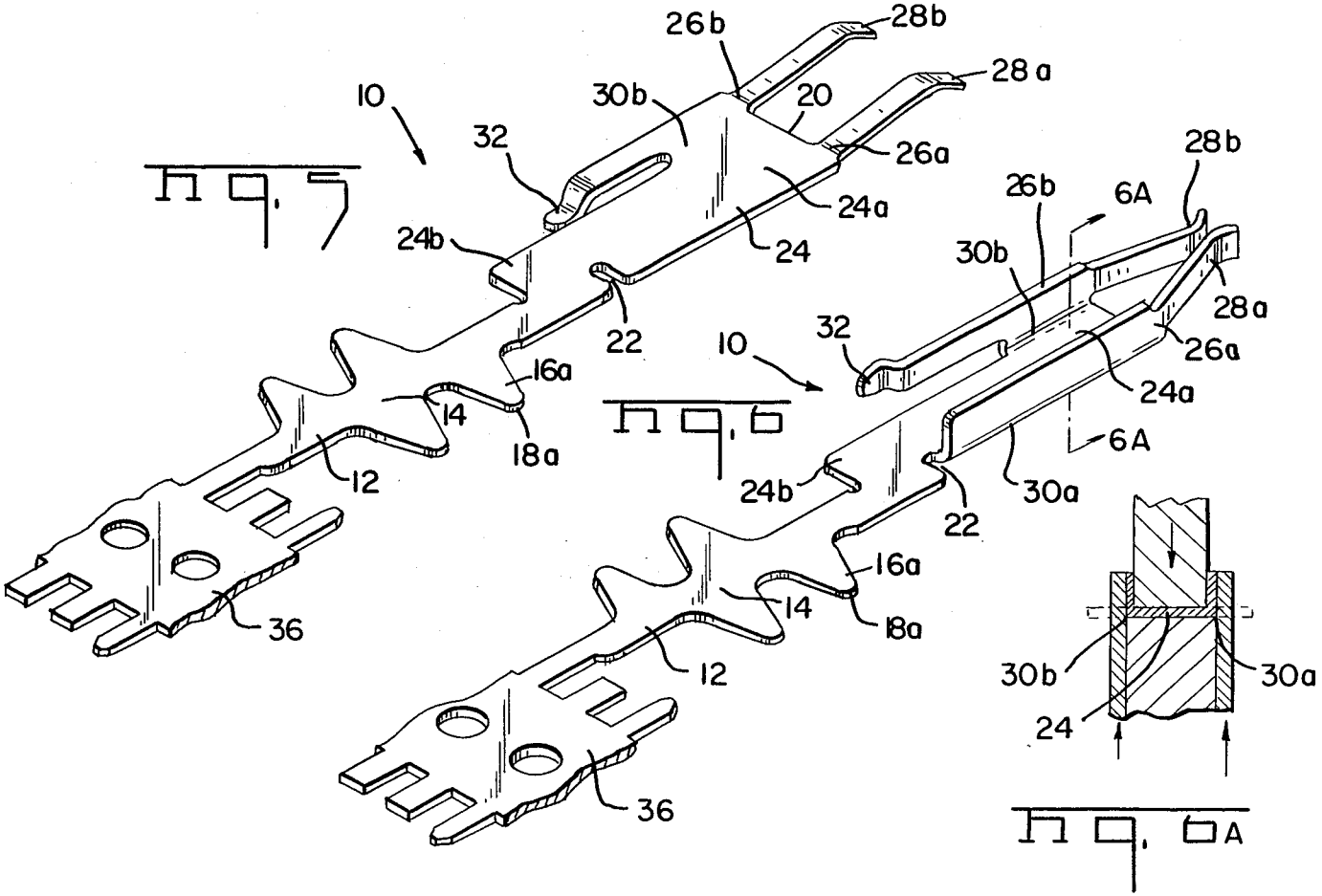
FIG. 6 is a view of a subsequent intermediate forming stage with FIG. 6A illustrating the corresponding forming operation.
FIG. 7 is a view of the terminal at the final forming stage with FIG. 7A illustrating the corresponding forming operation.
Figure 7:
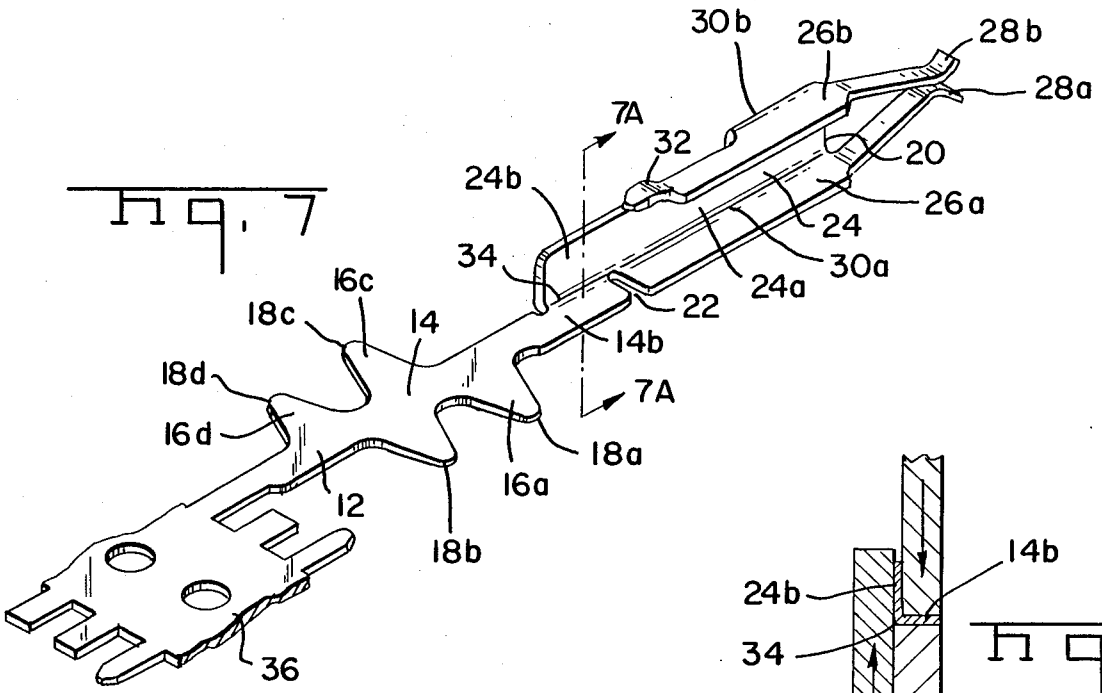

FIGS. 5 and 6 demonstrate intermediate configurations with the resilient arms 26a and 26b being formed upwardly relative to the base 24 in FIG. 6. Note that the constricted contacts 28a and 28b would be formed prior to bending the arms 26a and 26b upwardly relative to the base 24. A close tolerance can be held for the arms 26 and constricted contact portions 28 by conventional forming operations. As shown in FIG. 6A, a first forming member would engage the vertical base 24 and peripheral forming members on opposite sides of the vertical base 24 would bend the resilient arms 26a and 26b upwardly relative to vertical base 24.

Figure 7A:
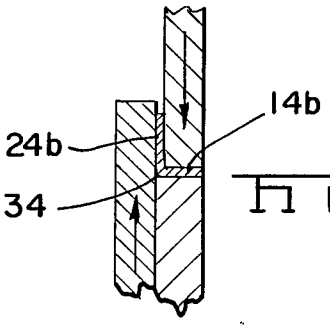

FIG. 7 represents a substantially final forming operation in which the bend line 34 is established between the horizontal base 14 and the vertical base 24. Note that bend line 34 extends substantially axially relative to the terminal 10. Note that the horizontal base 14 is not directly connected to the horizontal arm 26a even though horizontal arm 26a is substantially in the same plane as the horizontal base 14. Positioning bend line 34 in the position shown in FIG. 6 is important because the horizontal base 14 can be engaged by a first forming member whereas a second forming member can engage the base 24 to form the bend line 34, as shown in FIG. 7A. In this manner, a contact configuration can be formed in which the final configuration can be adequately controlled to form a functional product.

After the contacts are formed on carrier strips 36, the separate arrays of conductors can be interfitted by offsetting the terminals and then inserting the assembled arrays into a first partially inserted position, as shown in FIG. 2. Latch 32 engages a first latch engaging cutout 44 adjacent one face of the housing. In this configuration, the cable interconnection portions extend outwardly beyond a first face of the housing and are not inserted into the compartments forming a horizontal row in the housing 4. In this configuration, the frangible carrier strips 36 can be removed and a flat conductor flexible cable 6 can be aligned with the terminals such that tapered ends 18 of crimp tang 16 penetrate the insulation 42 in the cable and engage and penetrate the cable conductors 40. All of the terminals can be mass terminated in this manner and the terminals can then be subsequently mass inserted into a fully inserted position such as that shown in FIG. 3 in which the retention lance 32 engages the second latch engaging cutout 46 more closely adjacent the opposite face of the housing 6. Pins or posts 8 can then be inserted through the forward face of the housing 6 into the compartments 48 with the pins 8 engaging the constricted contact portions 28a and 28b of the contact. Note that constricted contact portions 28a and 28b engage the top and bottom of the individual posts or pins 8, thus promoting use of this connector on closely spaced pins. Furthermore, note that the pins 6 are arranged in a horizontal row corresponding to the horizontal orientation of the conductor portion 12.

It should be understood that this invention is not limited to the preferred embodiment depicted herein. For example, the conductor engaging portion need not comprise a crimp configuration but could employ an insulation displacement type configuration in which opposed edges of a terminal would penetrate the insulation and engage the underlying conductors, be they flat conductors or round conductors on similar centerlines. Therefore, the invention, as claimed herein, would not be limited to the specific configuration of the preferred embodiment.

What is claimed:

1. A stamped and formed terminal for interconnecting first and second electrical conductors, the terminal having first and second conductor interconnection portions; the first conductor interconnection portion comprising a horizontal base and at least one upstanding conductor engaging member formed out of the plane of the horizontal base; the second conductor interconnection portion comprising a vertical base and first and second resilient arms on opposite sides of the vertical base formed out of the plane of the vertical base, the first resilient arm being substantially horizontal; the vertical base of the second interconnection portion being integral with the horizontal base of the first interconnection portion intermediate opposite ends of the terminal with a right angle bend formed between the vertical and horizontal base; each resilient arm being joined only to the vertical base.

2. The terminal of claim 1 wherein the first horizontal arm is in substantially the same plane as the horizontal base and spaced from the horizontal base by an intervening slot, both the horizontal base and the first horizontal arm being joined to the intermediate vertical base therebetween.

3. The terminal of claim 1 wherein the first interconnection portion comprises means for establishing a crimped electrical contact with an insulated flat conductor and the second interconnection portion comprises means for establishing electrical contact with a free standing pin.

4. The terminal of claim 1 wherein the right angle bend extends about an axis extending between opposite ends of the terminal.

5. The terminal of claim 1 wherein the first interconnection portion includes upstanding conductor engaging members on opposite sides of the horizontal base.

6. The terminal of claim 5 wherein the upstanding conductor engagable members comprise deformable crimp tangs.

7. The terminal of claim 6 wherein the crimp tangs are tapered, the free ends comprising means for penetrating the insulation surrounding a flat conductor and engaging the flat conductor when deformed.

8. The terminal of claim 7 wherein a plurality of crimp tangs are formed on opposite sides of the horizontal base, crimp tangs on opposite sides being staggered.

9. The terminal of claim 1 wherein both the first and second resilient arms are horizontal and opposed.

10. The terminal of claim 9 wherein the first and second arms are formed inwardly to define a constricted conductor contact adjacent a forward end of each arm.

11. The terminal of claim 10 wherein the rearward end of the second arm is formed outward to define a retention lance.

12. An electrical connector for establishing an electrical interconnection between a plurality of closely spaced electrical pins in a horizontal row and cable conductors in a horizontal insulated cable including: a terminal stamped and formed from a spring metal blank and comprising a first cable conductor interconnection portion joined to a second pin interconnection portion; the cable conductor interconnection portion adjacent a first end of the terminal comprising a horizontal base and conductor engaging members formed upwardly from opposite sides of the horizontal base; the pin interconnection portion adjacent a second end of the terminal comprising a vertical base and upper and lower resilient pin contact arms formed outwardly from the top and bottom of the vertical base respectively, the upper and lower arms being substantially horizontal and having constricted contact ends, the upper resilient pin contact arm being spaced above the horizontal base of the cable interconnection portion and the lower resilient pin contact arm being in substantially the same plane and spaced from the horizontal base of the cable interconnection portion; the vertical base of the pin interconnection portion being joined with the horizontal base of the cable conductor interconnection portion intermediate the first and second ends of the terminal by a right angle bend.

13. The connector of claim 12 further comprising a multi-compartment insulative housing with a terminal disposed in each compartment.

14. The connector of claim 13 wherein a latch extends outwardly from the terminal, the housing having first and second latch engaging means for retaining the terminals in a partially inserted and fully inserted position resepctively; the cable interconnection portion comprising means for establishing electrical contact with the cable conductors when the terminals are partially inserted in the housing.

15. The connector of claim 13 wherein the spacing between adjacent compartments in the housing is no greater than 0.0500 inch.

16. A mass termination electrical connector for establishing an electrical interconnection between a plurality of pins in a horizontal row spaced apart by a distance no greater than 0.0500 inch, and cable conductors in a horizontal insulated cable, adjacent conductors being spaced apart by the same distance as adjacent pins, the connector comprising:

an insulative housing having a horizontal row of compartments extending between opposite faces, adjacent compartments being spaced apart by the same distance as adjacent pins;

a plurality of arrays of adjacent stamped and formed terminals, adjacent terminals in each array being spaced apart by a distance equal to a multiple of the spacing between adjacent pins, the terminals in the arrays being insertable into one face of the housing compartments by offsetting terminals in separate arrays, the terminals in each array being in the same row;

each terminal further comprising a first cable conductor interconnection portion joined to a second pin interconnection portion;

the cable conductor interconnection portion adjacent a first end of the terminal comprising a horizontal base and conductor engaging members formed upwardly from opposite sides of the horizontal base; the pin interconnection portion adjacent a second end of the terminal comprising a vertical base and upper and lower resilient pin contact arms formed outwardly from the top and bottom of the vertical base respectively, the upper and lower arms being substantially horizontal and having constricted contact ends, the upper resilient pin contact arm being spaced above the horizontal base of the cable interconnection portion and the lower resilient pin contact arm being in substantially the same plane and spaced from the horizontal base of the cable interconnection portion; the vertical base of the pin interconnection portion being joined with the horizontal base of the cable conductor interconnection portion intermediate the first and second ends of the terminal by a right angle bend.

17. The connector of claim 16 wherein terminals in each array are joined by a frangible carrier strip on the terminal adjacent the cable conductor interconnection portion.

18. The connector of claim 17 wherein a latch extends outwardly from each terminal, the housing having first and second latch engaging means for retaining the terminals in a partially inserted and fully inserted position respectively; the carrier strips being frangible when the terminals in each array are partially inserted in the compartments.

19. The connector of claim 18 wherein each cable interconnection portion comprises means for establishing electrical contact with the cable conductors after the carrier strips have been removed and while the terminals are partially inserted in the housing

* * * * *